United States Patent [19]

Osburn et al.

[11] Patent Number: 4,619,052

[45] Date of Patent: Oct. 28, 1986

[54] PROCESS AND APPARATUS FOR DRYING AND CLASSIFYING PARTICULATE GRANULATE MATERIAL

[75] Inventors: Larry E. Osburn, Harlingen; Melvin W. Wells, Spring, both of Tex.

[73] Assignee: Dresser Industries, Inc., Dallas, Tex.

[21] Appl. No.: 745,180

[22] Filed: Jun. 17, 1985

[51] Int. Cl.[4] ..... F26B 3/10

[52] U.S. Cl. ..... 34/10; 34/15; 34/57 R; 34/57 D; 34/57 E; 34/92

[58] Field of Search ..... 34/10, 15, 57 R, 57 A, 34/57 D, 57 E, 77, 82, 92; 209/144

[56] References Cited

U.S. PATENT DOCUMENTS

| | | | |
|---|---|---|---|
| 2,290,068 | 7/1942 | Petersen | 34/10 |
| 2,716,936 | 9/1955 | Kopf | 34/77 |
| 3,592,395 | 7/1971 | Lockwood et al. | 34/10 |
| 3,597,850 | 8/1971 | Jenkins | 34/10 |
| 3,762,063 | 10/1973 | Mullner | 34/8 |
| 4,070,765 | 1/1978 | Hovmand et al. | 34/12 |
| 4,170,074 | 10/1979 | Heckman et al. | 34/57 |
| 4,245,399 | 1/1981 | Muller et al. | 34/77 |
| 4,245,570 | 1/1981 | Williams | 110/238 |
| 4,319,409 | 3/1982 | Scholz et al. | 34/57 E |
| 4,454,825 | 6/1984 | Musto | 209/144 |

*Primary Examiner*—Albert J. Makay
*Assistant Examiner*—David W. Westphal
*Attorney, Agent, or Firm*—Richard M. Byron

[57] ABSTRACT

A direct heat drying and classifying system for the continuous drying of moist particulate granulate material in a mixer by agitating in a hot air flow between stirring blades and a rotary screen with oversized particles of material being removed, hot air being recycled and moisture removed from the recycled air.

2 Claims, 1 Drawing Figure

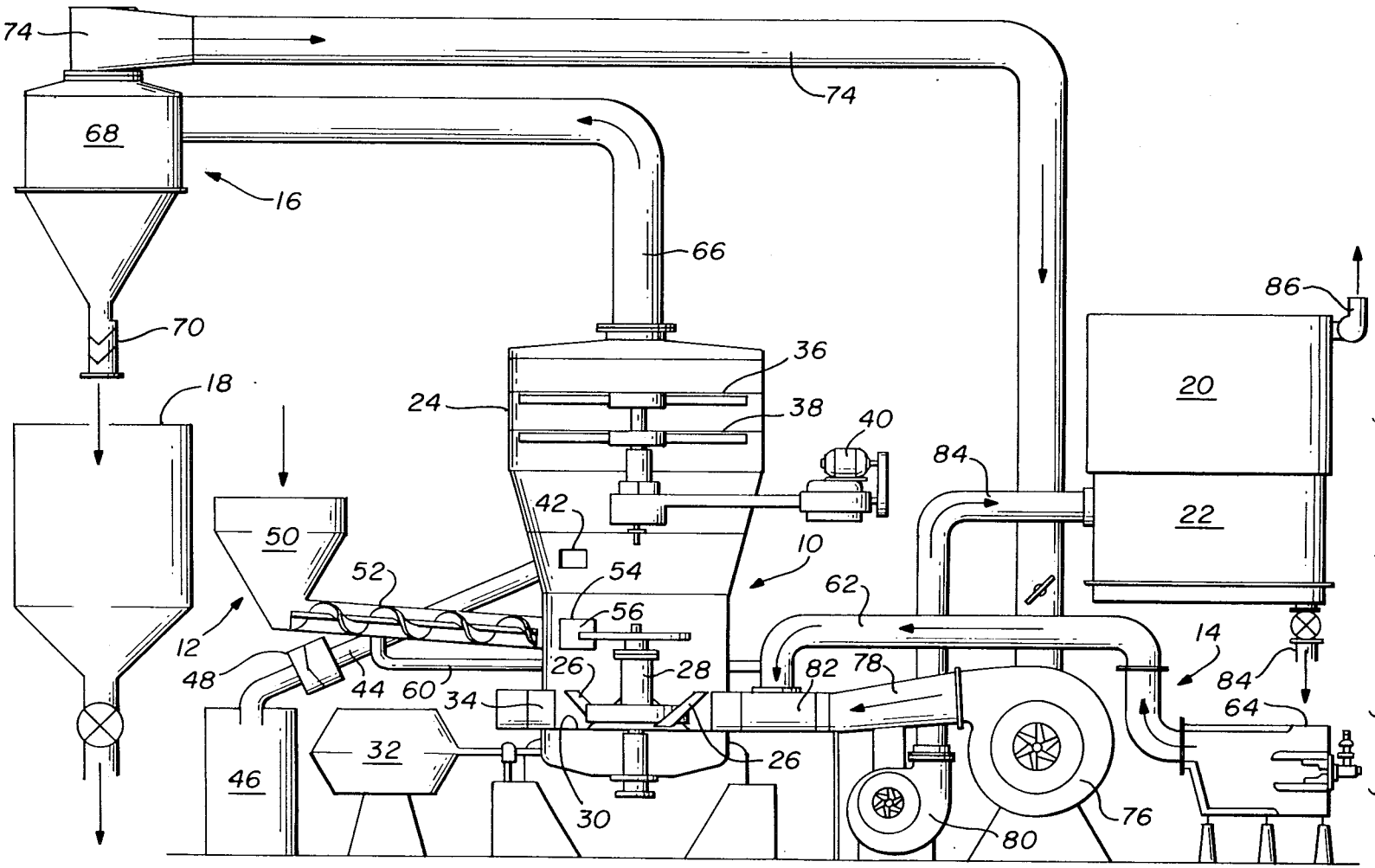
86
20
22
84
64
14
76
80
84
74
40
62
78
82
36
38
10
26
66
28
54
56
30
42
26
34
24
60
32
52
44
50
16
48
46
12
18
70
68
74

PROCESS AND APPARATUS FOR DRYING AND CLASSIFYING PARTICULATE GRANULATE MATERIAL

BACKGROUND OF THE INVENTION

The present invention relates to processes and apparatus for the drying of moist particulate granulate material and classifying the material to provide a substantially dry particulate granulate product. The particular product dried by this process is a ground specular hematite used as a conditioning or weighting agent for oil field drilling muds. This material is basically an iron ore that is ground to a fine almost powder-like consistency then transported in a water slurry from the grinding site to storage that is usually outdoors. In arid climates it is necessary to dampen the outdoor storage piles of material in order to prevent it from blowing.

In this somewhat moist state this material has a tendency to stick on surfaces such as the sidewalls etc. in bulk handling pneumatic conveying equipment. Therefore, in order to be properly fluidized by pneumatic conveying equipment it is necessary to dry this material to a low moisture content in order for it to be handled in this type of conveying equipment. In the present drilling fluid industry the equipment utilized to transport large quantities of bulk materials such as the ground specular hematite material mentioned above is pneumatic conveying systems that fluidize the particulate material for transport through conduits into reservoirs, containers, hoppers, etc. that are adapted for handling this type of particulate material as is well known in the art. Because of the need to be handled in this manner and transported by trucks from the processing plant to a well site or remote oil field storage facility the material must be adapted for this convenient and traditional handling procedure. Because of the particular characteristics of this material unless it is very dry it will stick to the sides of the conduits and containers thus making transportation substantially more difficult as well as requiring substantial cleaning and maintenance of the equipment.

In the prior art processes the drying of slurries and very moist particulate granulate material has been done in cement manufacturing processes by using a rotary kiln to evaporate the moisture as well as other apparatus to reduce the particle size. One example of this is in U.S. Pat. No. 2,290,068 to L. S. Peterson wherein a raw slurry is mixed with the dried product and this mixture dried in a rotary kiln. This patent represents one general technique for drying this character of material wherein a dried material is mixed with a raw moist material and the combination dried together.

Another concept in drying a slurry or moist product is represented in U.S. Pat. No. 3,592,395 to R. M. Lockwood wherein a fluidized bed dryer is provided to stir and dehydrate the product by the motion of air through the product and in conjunction with a rotary agitator to stir the product.

Other drying apparatus for this type of material is shown in U.S. Pat. No. 4,070,765 to S. Hovmand et al wherein a pneumatic conveyor dryer is used in the drying process. This apparatus also includes recycling a portion of the dried material as well as classifying the material to remove oversized particles as well as disintegration of the oversized particles.

The deficiencies in the prior art equipment and processes for drying the specular hematite material lie in the need for continuous drying and dust removal aspects as well as classifying the material to remove a typically small quantity of oversized particles. While the above noted processes could possibly be used to dry the moist specular hematite they would be inefficient in that it has been found that recycling of the dried material into the raw product stream is unnecessary and classification of the material is typically simple due to the small quantity of oversized particles.

SUMMARY OF THE INVENTION

In an embodiment of the apparatus of this invention a mixer is provided with a blade assembly in a lower portion thereof to mix and stir the moist particulate granulate material in a upwardly moving hot air flow. The moist particulate granulate material is displaced into the mixer through a screw conveyor and the material can be preheated with hot air in this conveyor if desired. The material is agitated vertically between the blade assembly in the mixer's lower portion and a rotary screen positioned in the upper portion of the mixer. Dried particles passing through the rotary screen are carried from the mixer in the hot air flow and separated from the hot air flow in a cyclone separator. The cyclone separator discharges dried material into a storage container. Hot air from the cyclone separator has, a portion extracted for dust and moisture removal prior to being recycled into the mixing apparatus.

An embodiment of the method of this invention involves mixing the moist particulate granulate material in a hot air flow and agitating the material in a mixer between a blade assembly and a rotary screen. Material passing the rotary screen is separated from the hot air flow in a product separator. After separation of the product material the hot air flow is recycled into the mixer. A portion of the hot air flow is extracted for moisture removal and dust collection. Classification of material occurs in the mixing process during agitation and the oversized particles are removed.

One object of this invention is to overcome the aforementioned disadvantages of the prior art devices in drying moist particulate granulate material.

Still, one other object of this invention is to provide a material processing system for drying moist specular hematite from a content of at least about 10% moisture by weight to dried material of about 0.1% to about 0.3% moisture by weight in order for the material to be easily transported and processed in pneumatic conveying equipment.

Still, one other object of this invention is to provide a processing apparatus that will operate continuously to dry moist particulate granulate material and classify same by removing small quantities of oversized particles.

Various other objects, advantages, and features of this invention will become apparent to those skilled in the art from the following discussion, taken in conjunction with the accompanying drawing in which:

DESCRIPTION OF THE DRAWING

FIG. 1 is a semi-pictorial and schematic diagram of the system of the present invention adapted for carrying out the process of the present invention.

The following is a discussion and description of preferred specific embodiments of the apparatus and process of this invention, such being made with reference to the drawing in which the same reference numerals are used to indicate the same or similar parts and/or structure. It is to be understood that the following discussion and description is not to unduly limit the scope of the invention.

DETAILED DESCRIPTION

Referring to the FIG. 1 the system of this invention includes several major components including a mixer assembly 10 that receives the raw material from a raw material conveyor system 12 and hot air from a hot air source system 14. The particulate granulate raw material and the hot air are mixed in mixer assembly 10 and passed by the hot air flow to a product separator 16 where the dried material is deposited into a storage container 18. Hot air is recycled by a fan connected to product separator 16. A portion of the recycled hot air is extracted and passed through a dust separator 20 and a moisture separator 22 for the respective removal of dust and moisture from the drying system.

Mixer assembly 10 includes a vertically elongated mixer container 24 with a stirring device in the lower portion thereof including a blade assembly with a plurality of plows 26 mounted on a rotatable plow support structure 28. The lower ends of plows 26 are positioned above the container bottom 30 a substantial distance. Rotatable plow support structure 28 is rotated by a gear drive assembly in the lower portion of the mixer container and powered by a variable speed drive unit 32. Plows 26 are constructed to contact material on a lower end or point and displace this material upwardly as the blade assembly rotates. Preferably four such plows are used although more can be used for larger sized mixers.

A plenum chamber 34 is provided around the lower portion of mixer container 24. Plenum chamber 34 is connected to hot air source system 14 and functions as the location of hot air egress into the interior of mixer container 24. Plenum chamber 34 is located in the lower portion of the mixer assembly in the approximate location to the elevation of the plows and the blade assembly so that hot air is moved into the material at this location as it is stirred by movement of plows 26.

In the upper portion of mixer container 24 a rotary screen assembly is provided as a portion of the apparatus to classify the material being dried. The rotary screen assembly includes an upper blade 36 and a lower rotating blade 38. Blades 36 and 38 are multiple vaned or finned blades that function as deflectors. Because of the rotating operation the rotational speed of the blades governs the opening space or flow path through which a particulate material can move in the hot air flow. The rotary screen assembly is powered by an external variable speed drive unit 40. The plurality of individual blades comprising the separate upper and lower blades of the rotary screen function as deflectors to reject oversized particulate material and direct them downward in the mixing container to the stirring plows in the lower portion of the mixer. For specular hematite material the rotary screen rejects material larger than about 1/16" or larger in span and passes material of about 200 mesh or less. This motion agitates the material being dried between the stirring blade assembly and the rotary screen. Material stirred and displaced upward by the plows is further lifted by the hot air flow. As the material is mixed with this air flow subsequently portions of this material will pass through the rotary screen and into product separator 16 whereas other portions of the material are rejected and deflected downward along the interior surface of mixer container 24 below the rotary screen and adjacent thereto inside the mixer.

It is to be noted that when the system is in operation air flow through mixer assembly 10 reduces the static pressure in mixer container 24 to a pressure below atmospheric. As a result of this pressure differential some amount of raw material can be drawn into mixer container 24 from the adjoining end portion of screw conveyor 52. Also, the discharge of oversized material from mixer container 24 must be isolated from the atmospheric pressure to prevent a substantial quantity of cool air from being drawn into the system. Because of the reduced pressure in which the drying and agitation of the material takes place this assists in removal of moisture from the raw material. The assistance of reduced pressure on drying and evaporation of materials is well know, thus it is important for mixer container 24 to be substantially sealed to prevent degradation of the pressure differential and the entry of cool air into the system at this location.

Classification of material passing through the mixer is accomplished as material rejected by the rotary screen assembly moves downward over the interior surface of the mixer container. To remove the oversized material an oversized material outlet 42 is provided in the wall of mixer container 24. Due to the mass difference between the oversized particles and the fine material the oversized particles are thrown outward against the interior wall of mixer container 24. These oversized particles are extracted from the mixer when they pass outlet 42. Outlet 42 is connected by conduit 44 to an oversized material collector receptacle 46. A drop valve 48 is connected in conduit 44 to limit air entry into the mixer. Drop valve 48 opens when a sufficient quantity of material is accumulated to overcome a force openable valve member and permit this material to drop into receptacle 46. The oversized material is generally material not suitable for use in the finished product and it is discarded as waste.

The placement of oversized material outlet 42 in mixer container 24 is critical in that it must be above the raw material inlet to this container. Preferably oversized material outlet 42 is placed in a tapered section of the mixer container side wall below the rotary screen and above the raw material inlet. In practice it has been found that one such oversized material outlet is sufficient due to the recirculating agitation occurring in the mixer although additional such outlets may be added if desired.

The raw material conveyor portion of this system includes a hopper or the like 50 that is adapted to receive raw material as it carried to this equipment from a stockpile source by a front end loader or other equipment. Because this material is moist and a positive feed conveying system is provided from hopper 50 to mixer container 24 by a screw conveyor 52. Screw conveyor 52 exits the bottom of hopper 50 and extends to opening 54 in a sidewall of mixer container 24. A cover 56 is provided over opening 54 on the interior of mixing container 24. This cover 56 is a flap of flexible material attached across an upper portion of opening 54 that is deformed by raw material as it enters the mixing container and drops downward. Flexible cover 56 functions to provide some sealing between the interior chamber of mixing container 24 and the interior of screw conveyor 52. This is needed because at normal operation the interior of mixing container 24 will be at a pressure below atmospheric. As material is pushed into the mixer this cover is displaced allowing the material to enter the container yet preventing it from being drawn into the container at an excessive rate due to the differential pressure.

One feature of this system is that raw material can be preheated before entering the mixer. This is accomplished by passing a portion of the hot air flow from hot air source 64 into a preheating connecting conduit 60 that joins screw conveyor 52 at a location substantially spaced from mixer container 24. Preheat air flow conduit 60 is connected to hot air source conduit 62 between the air heater 64 and the location at which it is connected to mixer assembly 10.

The output from mixer assembly 10 is through a mixer output conduit 66 from the top of mixer container 24 that connects to the inlet of a cyclone separator 68. Cyclone separator 68 is provided with a double valve outlet assembly 70 to permit the dried product to drop from the cyclone separator into storage container 18. Cyclone separator 68 has an outlet 72 on the upper portion thereof that is connected by conduit 74 to the inlet of recirculating fan 76. Recirculating fan 76 has its outlet connected to a conduit T-section 78. Conduit T-section 78 has a main inlet and outlet and an auxiliary outlet that is connected to the inlet of a dust collector fan 80. The main outlet of conduit T-section 78 is connected to a second conduit T-section 82 that joins first conduit T-section 78 with the air inlet of mixer assembly 10. Hot air conduit 62 from air heater 64 joins second conduit T-section 82 to place heated air into the recirculating air flow stream at the inlet to mixer assembly 10.

Dust collector fan 80 has its outlet connected by conduit 84 to moisture separator 22 and dust separator 20. Referring to FIG. 1 both the dust and moisture separators are shown as portions of one combined unit with the dust separator being located above the moisture separator. The extracted air flow enters this combined unit and moisture can be extracted from the air flow prior to the passage of air to the dust separator. Moisture that is separated from the air flow can be disposed of as waste via a moisture or water outlet drain 84 or passed as vapor to the atmosphere through vent 86. Output from dust collector 20 is in the form of substantially clean air exhausting to the atmosphere through vent 86. Dust removed from the air flow is removed to waste storage through a dust outlet (not shown). It has been found that a simple bag type dust filter will vent the moisture and also clean the exhausted air sufficiently for atmospheric discharge.

In operation of the system the raw material is introduced into hopper 50 for transport through screw conveyor 52 into mixer assembly 10 where it is mixed with heated air. The raw product is a ground specular hematite that can vary in moisture content between about 7% to about 10% moisture by weight depending upon storage conditions of the material. In this condition it is slightly sticky and will cling to sides of the hopper and in some instances form lumps. Screw conveyor 52 is used to provide a positive means of distribution of the raw material into mixer assembly 10. The hot air flow through mixer assembly 10 is a portion of the pneumatic conveying system. Hot air exiting heater 64 is introduced into the hot air flow stream at the lower portion of mixer assembly 10. Raw moist material is stirred in the lower portion of the mixer by a blade assembly including a plurality of plows 26. An agitating action mixes the raw material with the hot air flow between the blade assembly and a rotary screen assembly in the upper portion of mixer 10. Finely divided material is passed out of the mixer through its top outlet and oversized material is classified, removed, and discharged through oversized material outlet 42 in a side opening of the mixer. Next in the process dried material is carried by the hot air flow from mixer assembly 10 to product separator 16. Product separator 16 can include a cyclone separator 68 to separate the product from the air flow stream leaving only dust and moisture entrained in the hot air flow. The dried particulate granulate material is then placed in a storage container 18 and can now be fluidized for transport, handling and storage as described above. Next, this hot air flow from product separator 16 is recycled to the mixer with a portion of the air flow being extracted and passed through dust separator 20 and moisture separator 22 for removal of the dust and moisture respectively.

EXAMPLE

One apparatus has been constructed to practice the system and the associated method of this invention. This system has achieved a flow rate of as high as 10 tons per hour for raw specular hematite material of the character described having a moisture content of approximately about 7% by weight. In this process air is supplied from the heater at approximately 800° F. The air flow temperature in the plenum chamber 34 of the mixer is approximately 260° F. As the air flows through the system overall temperature change between the mixer lower portion and the fan inlet is approximately 60° F. Associated with this flow rate the material is dried from the approximate 7% moisture content to a moisture content of about 0.1% up to about 0.3% by weight. The finished product is a particulate granulate material that is sufficiently finely divided so that at 99% and above will pass through a 200 mesh screen. It has been found that the finished product meeting these specifications can be utilized in the product handling and distribution equipment as is other such particulate granulate materials utilized in the oil and gas well drilling industry.

Although specific preferred embodiments of the method and the apparatus of this invention have been described in detail in the preceding description this description is not intended to limit the invention to the particular form or embodiments disclosed herein since they are to be recognized as illustrative of the invention rather than restrictive and it would be obvious for those skilled in the art that the invention is not so limited.

The invention is declared to cover all changes and modifications of the specific example of the invention herein disclosed for purposes of illustration which does not constitute departures from the spirit and scope of the invention.

In the embodiments of the invention in which an exclusive property or privilege is claimed are defined as follows:

1. A process for drying a moist particulate ground specular hematite in a material handling system including a pneumatic conveyor, a mixer, a product separator, and a waste product separator, comprising continuously charging preheated particulate hematite having a moisture content of about 7 to about 10 weight percent by means of a screw conveyor into a mixer; continuously stirring the moist hematite in the mixer with a hot air moving in a forced hot air system by passing hot air upward through the mixer thereby agitating the moist material between rotating blades operable in displacing the moist material in an upwardly direction in an air flow dehydration of the material by introducing the hot air flow at a location below the rotating blades in a swirling flow substantially uniformly around a zone in the mixer below the rotating blades for movement upward through the mixer so as to pass the hot air upwardly to surround and pass the rotating blades; passing the material through a rotary screen comprising a pair of rotating multi-vained blades rotating at a relative speed such that finely divided materials pass in an upward direction and particles greater than approximately 200 mesh in span are rejected downwardly; and removing the oversized particles of material from said air stream that do not pass through the rotating screen and discharging them from the mixer; said stirring and said agitating occurring in an air pressure zone that is below atmospheric pressure while regulating the flow of moist particulate granulate material to said mixer and the moisture removal from the air in order to dehydrate the moist particulate granulate material to a product having approximately less than about 0.3 weight percent of moisture content; separating dried material from the air in the air flow in a product separator and collecting the dried granular particulate material product; and separating moisture and dust from a portion of the air stream in a waste product separator and recycling the remainder of the hot air into the mixer.

2. A system for drying moist particulate granular matter including a conveyor, a mixer, a product separator and a waste product separator comprising:

(a) a conveyor means operably connected to said mixing means product inlet including a hopper connected to an enclosed screw conveyor having its outlet at said mixer product inlet, with said conveyor means having means to vary the speed of operation thereof in order to regulate the flow of particulate granulate material moving into said mixing means;

(b) a means to preheat said particulate granulate material in said screw conveyor including a conduit joining said source of hot air and said screw conveyor with said conduit joining said screw conveyor at a location substantially spaced from the outlet thereof; and (c) a mixing means having a closed container having a rotating blade assembly with a plurality of plows mounted to rotate in a circular motion in a lower portion thereof, a rotating screen assembly including a pair of multi-finned rotating blades in an upper portion thereof, a product inlet through a side portion thereof to pass moist particulate granulate material, a hot air inlet in a lower side portion thereof and an air and product outlet at an upper portion thereof, said mixing means being operable to agitate said particulate granulate material between said blade assembly and said rotating screen assembly and pass substantially dried less than 200 mesh particulate granulate material out of said container through said air and product outlet;

(d) a means with said mixing means to classify and separate oversized material greater than 200 mesh from the product before reaching said product separator means including individual blades of said rotating screen assembly being shaped to deflect oversized particles of material toward said mixing means closed container, and an oversized particle outlet through a sidewall of an upper portion of mixing means closed container between and above said mixing screen and below said rotating screens, connected by conduit to a separate container;

(e) a source of hot air operably connected to a circulating fan and connected by conduit to said mixing means;

(f) a product separator means operable to separate the dried material from the hot air flow and having an inlet, product outlet and an air outlet with said inlet connected by conduit to said mixer means and air and product outlets to receive dried product in the hot air flow;

(g) a moisture separating means and a dust separating means each respectively connected by conduit to said product separator outlet and each respectively being operable to remove moisture and dust from a portion of the hot air flow; and (h) a circulating fan connected by conduit to said product separator means air outlet for recycling hot air into said mixing means.

* * * * *